US006258208B1

(12) United States Patent
Lindeberg et al.

(10) Patent No.: US 6,258,208 B1
(45) **Date of Patent: *Jul. 10, 2001**

(54) METHOD FOR COMPLEX TREATMENT OF PULP IN CONJUNCTION WITH A CHLORINE DIOXIDE STAGE

(75) Inventors: Otto S. A. G. Lindeberg, Domsjö; Lars A. G. Ahlenius, Örnsköldsvik; Jan G. Lidén, Domsjö; Sture E. O. Noréus, Husum, all of (SE)

(73) Assignee: Mo Och Domsjo Aktiebolag, Ornskoldsvik (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/714,171

(22) PCT Filed: Apr. 4, 1995

(86) PCT No.: PCT/SE95/00361

§ 371 Date: Sep. 27, 1996

§ 102(e) Date: Sep. 27, 1996

(87) PCT Pub. No.: WO95/27100

PCT Pub. Date: Oct. 12, 1995

(30) Foreign Application Priority Data

Apr. 5, 1994 (SE) ..... 9401125

(51) Int. Cl.[7] ..... D21C 9/14; D21C 9/147; D21C 9/16

(52) U.S. Cl. ..... 162/65; 162/67; 162/76; 162/78; 162/80; 162/88; 162/89

(58) Field of Search ..... 162/76, 78, 65, 162/89, 66, 67, 88, 80, 79

(56) References Cited

U.S. PATENT DOCUMENTS 3,865,685 2/1975 Hebbel et al. .

(List continued on next page.)

FOREIGN PATENT DOCUMENTS 402 335 * 12/1990 (EP) ..... 162/78

(List continued on next page.)

OTHER PUBLICATIONS

Devenyns et al, "Optional use of hydrogen peroxide to design low AOX ECF Sequences", 1995 Pulping Conf., pp. 281–288, 1995.*

(List continued on next page.)

*Primary Examiner*—Steve Alvo
(74) *Attorney, Agent, or Firm*—Sughrue, Mion, Zinn, Macpeak & Seas, PLLC

(57) ABSTRACT

A method for the manufacture of bleached cellulose pulp, in conjunction with which lignocellulose material is digested to form cellulose pulp by means of an alkaline digestion liquor, and the cellulose pulp in the form of a suspension is screened, if necessary, and subjected in series to at least oxygen gas delignification/bleaching (O), if required, chlorine dioxide bleaching (D) and bleaching with non chlorine-containing, oxidative bleaching agent (O, P, Z), with the various bleaching stages interspersed with washing and/or reconcentration of the cellulose pulp in at least one stage, characterized in that complexing agents are added to the cellulose pulp in conjunction with the chlorine dioxide bleaching. It is also important for the mol quotient of the cellulose pulp for magnesium/manganese, during bleaching with a non chlorine-containing, oxidative bleaching agent, to be maintained at or brought to a value exceeding 20, and preferably exceeding 40.

26 Claims, 1 Drawing Sheet

U.S. PATENT DOCUMENTS

| | | | | |
|---|---|---|---|---|
| 4,238,282 | * | 12/1980 | Hyde | 162/89 |
| 4,959,124 | | 9/1990 | Tsai . | |
| 5,296,099 | * | 3/1994 | Griggs et al. | 162/89 |
| 5,352,332 | * | 10/1994 | Maples et al. | 162/65 |

FOREIGN PATENT DOCUMENTS

| | | | |
|---|---|---|---|
| 0 456 626 A1 | 11/1991 | (EP) | D21C/9/16 |
| 0500813 | 9/1992 | (EP) . | |
| 0622491 | 11/1994 | (EP) . | |
| 93012938 | 10/1994 | (SE) . | |
| 93012946 | 10/1994 | (SE) . | |
| 93025278 | 1/1995 | (SE) . | |
| WO8804706 | 6/1988 | (WO) . | |
| WO 94/20672 | 9/1994 | (WO) | D21C/9/10 |

OTHER PUBLICATIONS

Desprez et al., "One–Stage Hydrogen Peroxide Full Bleaching of Previously Delignified Softwood Kraft Pulp" TAPPI Pulping Conference pp. 443–452 (Nov., 1993).

Dillner et al., "Non–chloride Bleaching of MCC–Pulp" TAPPI Pulping Conference pp.213–221 (1989).

Igerud "Developments of the Lignox Process" European Pulp and Paper Week. (May, 1992).

Koyasin et al., "Bleaching of Sulphite Pulps Without Chlorine Compounds" International Pulp Bleaching Conference, vol. 3: 165–184 (1991).

Martell et al., "Chemistry of the Metal Chelate Compounds" Prentice–Hall, Inc. pp. 1–3, 38, 39 and 592–93 and Appendix 1 (1952).

Bryant et al., "Manganese Removal In Closed Kraft Mill Bleach Plants" TAPPI Pulping Conference pp.43–55 (1993).

Troughton et al., "The Efficient Use of Hydrogen Peroxide as a Chemical Pulp Delignification Agent" TAPPI Pulping Conference pp. 519–535 (1992).

* cited by examiner

METHOD FOR COMPLEX TREATMENT OF PULP IN CONJUNCTION WITH A CHLORINE DIOXIDE STAGE

TECHNICAL FIELD

The invention relates to a method for the manufacture of bleached cellulose pulp from any previously disclosed lignocellulose material using any previously disclosed alkaline pulping process and essentially environmentally friendly bleaching agents. A large number of lignocellulose materials is available in varying quantities throughout the world. one very common lignocellulose material is wood, which is usually reduced to the form of chips before digesting or cooking. The method in accordance with the invention is suitable for both hardwood and softwood. Examples of previously disclosed alkaline pulping processes are the sulphate process, the polysulphide process, and processes of the soda (sodium hydroxide) process type in which catalyzers, such as a quinone compound, are used. The term sulphate process covers, for example, the use, of high sulphidity, the use of counter-current digestion in which white liquor is also added at an advanced stage of the cooking process, and the use of a chemical treatment of the lignocellulose material prior to the actual sulphate cook.

BACKGROUND ART

In the interests of environment protection, the use of bleaching agents such as oxygen (O), a per-compound (P) such as hydrogen peroxide and ozone (Z) has recently been suggested for the bleaching of, for instance, sulphate pulp. This has led to the introduction, including on a commercial scale, i.e. full-scale, of the use of this type of bleaching agent, including those referred to above, and also in the sequence indicated above. By avoiding the use of bleaching agents containing chlorine, which finally give rise to corrosive chloride, it has proved increasingly possible to close bleach plants. The expression closing is used to denote that the (washing) liquids are treated to an increasing extent within the bleach plant. In traditional open bleaching plants, the washing liquids (waste liquors) remaining after the respective bleaching stage, including after the extraction (E) stage, are allowed to flow directly out to the recipient or, where appropriate, to an external purification measure.

It has emerged from the use of the oxidative bleaching agents exemplified above, and in particular from the use of a per-compound, that the content of metals in the pulp and/or the presence of metals in general often leads to problems. The metals that cause most problems are the transition metals, of which manganese is the most problematical due to the presence of manganese in such large amounts. Manganese, for example, occurs naturally in the raw material, i.e. in the lignocellulose material, for example in the form of wood. The process water that is used also contains manganese as a general rule, and manganese can also originate from the apparatus used in the pulp production chain. In an attempt to deal with this problem, a complexing agent stage (Q) has been introduced into the pulp treatment chain, preferably directly ahead of the peroxide bleaching stage. The addition of compexers such as EDTA, DTPA and NTA, and others at a suitable pH value, ensures that possibly free manganese ions are collected and, in particular, the manganese is converted from a fixed form in the cellulose pulp to a water soluble complexed form. Manganese complexes of the type $Mn(EDTA)^{2-}$ or $Mn(DTPA)^{3-}$ occur in this case. It is important, after this treatment stage, for the pulp to be washed extremely thorougly so that no significant quantities of manganese complexes and possibly free complexing agents accompany the cellulose pulp into the peroxide bleaching stage. The spent liquor generated at this point, i.e. the washing liquid from the complexing agent stage, has attracted the particular attention of experts.

The starting material for the manufacture of cellulose pulp, for example wood, as a general rule contains not only harmful metals, such as the transition metals referred to above, but also individual metals, such as mangnesium, which have a positive effect in the course of the bleaching of cellulose pulp with non chlorine-containing, oxidative bleaching agents such as hydrogen peroxide. When processing cellulose pulp to the point at which it is bleached with hydrogen peroxide, for example, every effort is accordingly made to retain the largest possible quantity of the original magnesium in the cellulose pulp. If the starting material in itself has a very low magnesium content, and/or if the magnesium is released from the cellulose pulp during one or more process stages, it is possible to add magnesium to the cellulose pulp, for example in the form of magnesium sulphate.

If, in the course of bleaching cellulose pulp, exclusive use is made of non chlorine-containing, oxidative bleaching agents, and particularly if these bleaching agents are not used in an optimal fashion, there is a risk of the strength characteristics of the bleached (including fully bleached) cellulose pulp becoming such that the cellulose pulp in question is not suitable as a starting material for special types of paper, i.e. types of paper for which the strength is of critical significance. It is possible in such cases, in place of a comparatively aggressive bleaching agent such as ozone, to use the chlorine-containing bleaching agent that is least environmentally unfriendly, i.e. chlorine dioxide (D). A major advantage of chlorine dioxide is that, at the same time as it produces a significant increase in the brightness of the cellulose pulp and also has a delignifying effect, it also leaves the cellulose pulp largely unaffected with regard to its strength, for example measured in the form of its intrinsic viscosity. The intrinsic viscosity of the cellulose pulp (measured according to standard method SCAN-C15:62) is an indirect indicator of the strength of the cellulose pulp and, to some extent also, of the strength of the paper produced from the cellulose pulp in question.

DISCLOSURE OF THE INVENTION

Technical problem

In the manufaeture of bleached cellulose pulp using at least one, and preferably several, environmentally friendly bleaching agents, the aim is to obtain a cellulose pulp with both sufficient brightness and good strength, at the same time as the bleaching sequence as a whole is utilized in an effective manner and one that is acceptable from an environmental point of view.

Solution The present invention represents a solution to the aforementioned problems and relates to a method for the manufacture of bleached cellulose pulp, in conjunction with which lignocellulose material is digested to form cellulose pulp by means of an alkaline digestion liquor, and the cellulose pulp in the form of a suspension is screened, if necessary, and subjected in series at least to oxygen gas delignification/bleaching (O), if required, chlorine dioxide bleaching (D) and bleaching with non chlorine-containing, oxidative bleaching agent (O,P,Z), with the various bleaching stages interspersed with washing and/or reconcentration of the cellulose pulp in at least one stage, charaterized in that a complexing agent is added to the cellulose pulp in conjunction with the chlorine dioxide bleaching.

The concept applied in conjunction with the chlorine dioxide bleaching process includes at least three addition positions, namely that the complexing agent is added to the cellulose pulp at a position ahead of the chlorine dioxide bleaching (the chlorine dioxide bleaching stage), after the chlorine dioxide bleaching (the chlorine dioxide bleaching stage), or at the chlorine dioxide bleaching (in the chlorine dioxide bleaching stage).

In the event of the complexing agent being added to the cellulose pulp in a distinct step, i.e. before the chlorine dioxide bleaching stage, it is appropriate for this to be done in accordance with a previously disclosed method.

Suitable parameters are: pulp consistency=1–40%, preferably=3–18%; temperature 20–150° C., preferably=50–95° C.; time=1–1000 minutes, preferably=30–300 minutes; complexing agernt (L) charge=0.1–10 kg ptp; pH=3–9.5, preferably=5–7.

The abbreviation ptp used above (and in the rest of this specification) stands for: per metric ton of absolutely dry pulp.

It is not necessary for a distinct step to be used for complexing agent treatment, and it is entirely possible for the complexing agent to be added directly to the advancing pulp flow just before or just after the chlorine dioxide bleaching stage under the conditions applicable to the pulp flow at these positions.

In these three embodiments of the invention, the following parameters are appropriate for the, chlorine dioxide bleaching; charge=5–40 kg ptp; time=15–240 minutes, preferably=30–180 minutes; temperature=40–90° C., preferably=60–80° C.; pulp consistency=1–40%, preferably=3–18%; pH=1.5–3.5.

In accordance with a preferred embodiment of the invention, the complexing agent treatment and the chlorine dioxide bleaching are performed in one and the same stage. A particularly important parameter in this respect is the pH value, which is maintained at a higher level than in a traditional chlorine dioxide bleaching stage and amounts to 3–7, preferably 4–6. Other parameters can be identified from the parameters indicated above for the respective stage, which fully or partially overlap (cover) one another.

A factor of central significance for a good final bleaching result to be achieved is to ensure that the cellulose pulp, when it is introduced into the processing stage with a non chlorine-containing, oxidative bleaching agent, has a magnesium/manganese mol quotient which does not fall below a lowest value. If this is the case, i.e. if the mol quotient is too low, then magnesium, for example magnesium sulphate, must be added to the cellulose pulp at cn earlier position. The numerical value of the aforementioned quotient may vary slightly depending on, amongst other things, the type of pulp and the bleaching conditions, although it should not fall below 20, whatever the conditions, and should preferably not fall below 40, expressed as mol magnesium in relation to mol manganese.

The starting material, for example the wood, may already contain too little magnesium, although this is unusual. The most common reason for the occurrence of an excessively low magnesium/manganese mol quotient is because the chlorine dioxide bleaching is performed at a conventional pH value, for example below 3. At such a low pH value in the cellulose pulp, most of the metals present in the pulp are leached out, including magnesium, and in excessively large amounts in the case of that particular metal. A certain proportion of the natural magnesium, which has been leached out in that way, must be replaced in this case with added magnesium, so that the aforementioned quotient is exceeded in the cellulose pulp.

The major advantage associated with the use of a higher pH value in the combined chlorine dioxide bleaching and complexing agent stage, i.e. 3–7, and preferably 4–6, is that the majority of the natural magnesium remains present in, the cellulose pulp, which means that it is not necessary to add any magnesium.

In order to be certain that there is no shortfall in the aforementioned critical magnesium/manganese mol quotient of the pulp in the aforementioned position, it is advisable to carry out a random sampling exercise to determine the aforementioned quotient of the pulp. It is extremely important for the process in accordance with the invention for the manufacture of the bleached cellulose pulp as far as this position to be controlled in such a way that the mol quotient for the magnesium/manganese in the cellulose pulp at this position does not fall below 20, and preferably does not fall below 40. It has been found, with regard to hardwood pulp, for the lower quotient to beexceeded, whereas it is often necessary, with regard to softwood pulp, for the higher quotient to be exceeded.

As far as the complexing agent (including a mixture of complexing agents) is concerned, it is necessary for it tio be added in a quantity at least equivalent to the stoichiometric quantity compared with the total quantity of manganese in the cellulose pulp and the surrounding liquid after the chlorine dioxide bleaching. It is preferable for the complexing agent to be added in at least a five-fold surplus.

Any previously disclosed complexing agent can be used. It is preferable, however, for the complexing agent (L) to have conditional complexing constant for bivalent manganese $Mn^{2+}$ for the reaction $Mn^{2+}+L^{n}\approx MnL^{2-n}$, which exceeds $10^{11}$ for a pH of 12. Examples of suitable complexing agents of this kind are ethylene diamine tetra-acetic acid (EDTA) and/or diethylene tri amine penta-acetic acid (DTPA).

What happens when the complexing agent is added to the cellulose pulp, either at a separate stage or to the advancing pulp flow, is that the complexing agent forms complexes with the available transition metals, in particular manganese, i.e. both manganese present in the liquid and manganese bonded to the pulp. The proportion of the manganese bonded to the cellulose pulp that is removed from it and forms complexes will depend on the parameters that apply at this position. The aim is to obtain the one hundred per cent removal of the manganese from the pulp, although this is essentially never achieved in reality. Examples of free manganese complexes in the liquid that normally surrounds the pulp fibres are $Mn(EDTA)^{2-}$ and $Mn(DTPA)^{3-}$.

As can be appreciated from the foregoing, the initial bleaching stage can consist of a chlorine dioxide stage. It is entirely possible in accordance with the invention, however, for this stage to be preceded by an oxygen gas delignification/bleaching stage. This may even be referable in certain positions, and with regard to certain types of cellulose pulp. Supplementary treatment with peracetic acid is also possible after this stage.

Such oxygen gas delignification of the cellulose pulp may be performed in accordance with any previously disclosed method, including both medium consistency delignification and high consistency delignification. The appropriate parameters for medium consistency delignification are: alkali (NaOH) charge=1–50 kg ptp, giving a pH of 9.5–12; oxygen gas charge=5–25 kg ptp; temperature=60–120° C.; dwell time 20–180 minutes; pressure=0.2–1 MPa. The oxygen gas delignification of the cellulose pulp can be performed in one or more consecutive reactors, with or without additional charging of chemicals.

Examples of non chlorine-containing, oxidative bleaching agents that must be used in the aforementioned positon are oxygen gas, ozone and any per-compound.

The oxygen gas delignification of the cellulose pulp has already been described. As far as the bleaching of cellulose pulp with ozone is concerned, this is performed, for example, at a pulp consistency of 8–16%, and the following parameters are otherwise applicable: temperature×30–80° C., preferably=45–55° C.; ozone charge=1–10 kg ptp, preferably=3–6 ptp; time 0.1–300 seconds, preferably 1–60 seconds; pH=1.5–6, preferably=2.5–3.5.

The preferred bleaching agent at this position is a per-compound, such as hydrogen peroxide, sodium peroxide, peracetic acid, peroxosulphate, peroxodisulphate, perborate or organic peroxides.

Of these per-compounds, the absolute preference is for hydrogen peroxide. Hydrogen peroxide bleaching can be performed both with and without pressurization. Appropriate parameters for bleaching at atmospheric pressure are: time=60–720 minutes, preferably=180–300 minutes; temperature=60–100° C., preferably=75–98° C., peroxide charge=1–50 kg ptp, preferably=2–20 kg ptp; alkali (NaOH) charge=1–30 kg ptp, preferably=4–10 kg ptp; pulp consistency=3–40%, preferably=8–18%. The alkali charge is adapted so that the pH value in the pulp suspension at the end of the bleaching stage, i.e. the break pH, lies within the range 10–11.5. A pressure of 0.2–1 MPa, preferably=0.4–0.6 MPa, is used for pressurization. Air and/or oxygen gas can be used for pressurization. Appropriate parameters in this case are: time=60–180 minutes; temperature=105–120° C.; peroxide charge 1–30 kg ptp; alkali (NaOH) charge=1–25 kg ptp. The same circumstances described above are applicable to the pulp consistency and the adaptation of the alkali charge.

As previously stated, the cellulose pulp must be subjected to at least one washing and/or reconcentration stage before and after the respective bleaching stage in the bleaching sequence containing two alternatively three bleaching stages described above. Any previously disclosed washing apparatus can be used. Examples of washing apparatuses are washing filters and washing presses. Single stage and two stage diffusers can also be used to advantage. Any previously disclosed press can be used for the reconcentration of the cellulose pulp.

It is particularly important for the cellulose pulp to be washed thoroughly before bleaching of the cellulose pulp with the non chlorine-containing, oxidative bleaching agent.

In the event of the complexing agent treatment being performed in a separate stage just ahead of the chlorine dioxide bleaching stage, it is both possible and advisable to wash the cellulose pulp after the first mentioned stage.

In accordance with the present invention, it is highly preferable to close the supply of liquid into the bleaching plant and back to the chemical recovery cycle as far as possible. As far as any initial oxygen gas bleaching stage is concerned, the spent bleaching liquor is returned to the system as a routine procedure. The same applies to the spent bleaching liquor (i.e. the suspension liquid obtained in the washings after this stage) from the non chlorine-containing, oxidative bleaching stage, i.e. usually the peroxide bleaching stage.

Between these bleaching stages, or alternatively ahead of the last mentioned bleaching stage only, there is present a chlorine dioxide bleaching stage, or alternatively a combined chlorine dioxide bleaching stage and a complexing agent stage. Although not preferred, it is entirely possible for the spent bleaching liquor from this stage containing a certain amount of chloride to be allowed to leave the liquid system, and for it to be led to the recipient or, before reaching that point, to a purification station of some kind.

It is preferred to permit the spent bleaching liquor also to be included in a closed liquid system, which is conveyed backwards in the system to the chemical recovery cycle, with final combustion of the concentrated spent liquor, i.e. a mixture of cooking liquor and bleaching liquor, in the recovery boiler. This highly preferred embodiment of the invention includes a requirement for the liquid (suspension liquid) used in conjunction with the washing of the cellulose pulp to be conveyed in essentially strict counter-current, in such a way that the pulp manufacturing process is essentially totally closed with regard to the liquid circuit, and that the pH value in the suspension liquid, in the absence of reducing agents, after any oxygen gas delignification/bleaching and onwards into the cellulose pulp treatment chain as far as the bleaching operation with the non chlorine-containing, oxidative bleaching agent, is caused to attain a maximum of 10, and that the carbonate content of the suspension liquid is caused to be the same as or to exceed a certain lowest value, depending on the position in the cellulose pulp treatment chain.

In order to prevent the breakdown of the previously mentioned water soluble manganese complexes and the subsequent re-absorption of manganese into the cellulose pulp, it is important to check and control the carbonate content in the suspension liquid at the treatment (including bleaching) stages described above, and above all, in the suspension liquid when it is used in counter-current as a washing (displacement) liquid for the cellulose pulp between the aforementioned treatment stages. The level of the carbonate content in the suspension liquid depends on the position at which the cellulose pulp is situated, as described in detail below.

The expression carbonate content denotes the total carbonate per liter of liquid, i.e. the quantity of $CO_3^{2-}$ plus the quantity of $HCO_3^-$ plus the quantity of dissolved $CO_2$.

It has been found to be advantageous if the carbonate content of the suspension liquid during the bleaching stage with the non chlorine-containing, oxidative bleaching agent, i.e. usually the peroxide bleaching stage, is equal to or greater than 3 millimol per liter. The fact that the carbonate content of the suspension liquid is also important in the peroxide bleaching stage situated after the complexing agent treatment of the cellulose pulp would seem to indicate that a certain quantity of manganese, which has not been dissolved from the pulp during the complexing agent treatment, nevertheless accompanies the cellulose pulp into the bleaching stage. The desired carbonate content of the suspension liquid can be achieved through the addition of a carbonate containing compound, or by allowing the suspension liquid to come into contact with air to such an extent that sufficient carbon dioxide is absorbed from the air and is transferred to carbonate ions. A third method is to add technical grade carbon dioxide.

At the position at which the suspension liquid meets the cellulose pulp just ahead of the first bleaching stage, the carbonate content should be equal to or greater than 10 millimol/liter, and the carbonate content should preferably exceed 40 millimol/liter.

In the embodiment of the invention in which bleaching of the cellulose pulp commences with an oxygen gas stage, the carbonate content in the suspension liquid should be equal to or greater than 4 millimol/liter, And should preferably exceed 10 millimol/liter, When the suspension liquid meets the cellulose pulp in conjunction with washing of same after the oxygen gas bleaching.

For certain purposes, it is sufficient to bleach the cellulose pulp in accordance with previously described two stage or three stage bleaching methods. The addition of, for instance, a further two bleaching stages gives fully bleached cellulose pulp, i.e. a cellulose pulp with a brightness of the order of 90% ISO or above. With the aim of producing the strongest possible cellulose pulp, it is appropriate for chlorine dioxide to be used in at least one of these stages. A preferred final bleaching sequence comprises one chlorine dioxide stage (D) followed by one peroxide stage (P). It is, of course, possible to utilize several other final bleaching sequences, of which a number are indicated below;

D-D, D-E-D, D-P-D, Z-P and Z-D.

The final bleaching of the cellulose pulp is, quite naturally, not restricted to just two stages, and it is possible to use both one and three stages, for example.

If only non chlorine-containing bleaching agents are used during the final bleaching process, the spent bleaching liquors (suspension liquids) from these bleaching stages, too, can be included in the strict counter-current washing without causing major problems, so that the pulp manufacturing process is essentially entirely closed with regard to the liquid circuit.

If chlorine dioxide is used in a final bleaching stage, then it may be possible in spite of this essentially to close the liquid circuit totally. This will depend on how much chlorine dioxide in total is charged during the bleaching sequence (subdivided into two bleaching stages), and on what level of chloride in the suspension liquid and the white liquor can be dealt with by the chemical recovery cycle, including the recovery boiler, without corrosion problems occurring.

It is entirely possible in accordance with the invention to employ a totally closed liquid circuit with regard to the initial two or three bleaching stages, whereas the spent bleaching liquor from a chlorine dioxide stage (as a third or fourth bleaching stage) is not conveyed in counter-current in the manner previously described, but this spent bleaching liquor is dealt with separately and is processed according to a special method or is released directly into the recipient.

More detailed information concerning the liquid circuit and the totally closed pulp manufacturing process, including various ways of expelling chlorides from the liquid system, are described in Swedish patent publication 9304173-9. Large parts of what is described in that specification are applicable to the method in accordance with the present invention.

Advantages

The method in accordance with the invention offers the possibility of manufacturing a cellulose pulp of high strength, at the same time as the brightness of the pulp can be adapted as necessary. Furthermore, the added bleaching chemicals are used in an effective fashion. In the preferred embodiment of the method in accordance with the invention, essentially all environmental problems caused by the release of liquid from the bleaching plant are avoided, and any remaining need for external purification is reduced to a minimum, which also brings down the overall cost of the pulp manufacturing process.

DESCRIPTION OF THE DRAWING

The FIGURE shows a process diagram for the manufacture of bleached softwood sulphate pulp in accordance with the invention, where the digestion takes place continuously.

BEST EMBODIMENT

Figure 1:
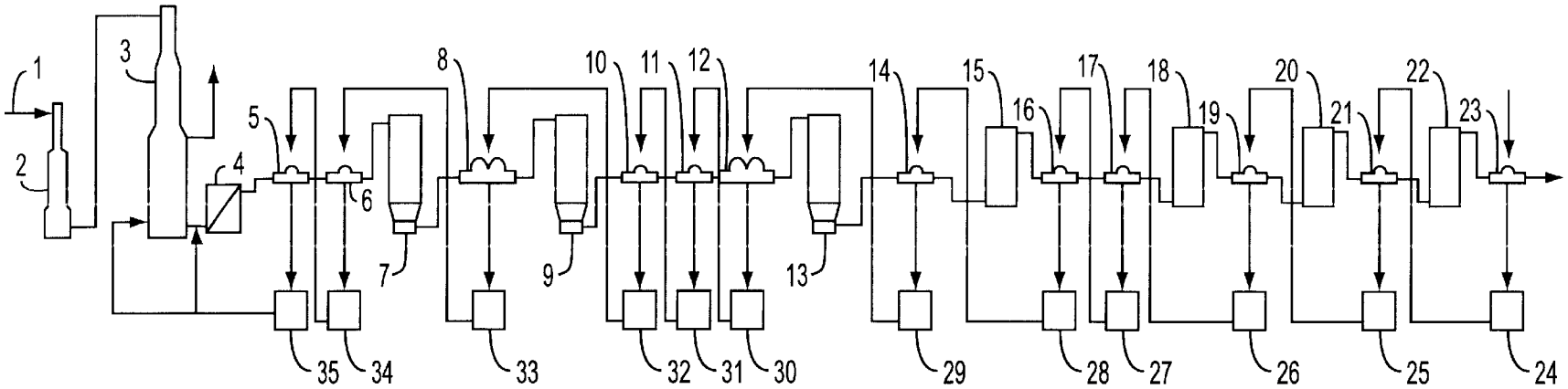

A preferred embodiment of the method in accordance with the invention is described below with reference to the FIGURE. In conjunction with this, a more detailed description is given of certain subsidiary stages in the process, and in addition other embodiments of the invention are described in greater detail. Finally, there follows a number of illustrative embodiments relating on the one hand to the application of the invention on a full scale basis, and on the other hand to laboratory trials simulating the method in accordance with the invention.

In the process diagram in accordance with the FIGURE, lignocellulose material in the form of pinewood chips is introduced via the line 1 into the pre-impregnation vessel 2. Digestion liquor in the form of white liquor, where appropriate mixed with spent digestion liquor or black liquor, is also introduced into the vessel. The material is then conveyed to the continuous digester 3. The lignocellulose material, which by this position has been transformed from wood chips to cellulose pulp in suspension form, is discharged at the lower part of the continuous digester. Before leaving the continuous digester 3, the cellulose pulp has undergone counter-current washing with spent bleaching liquor. The newly manufactured cellulose pulp contains a certain amount of lignin. The lignin content, measured as a kappa number, usually lies within the range 23–30 for conventional cooking, and 18–25 for modified cooking. The pulp suspension in question is screened in the screening unit 4, and the pulp that is accepted is conveyed onwards to two washing filters 5 and 6 connected in series. Lignocelluloset material separated in the screening unit 4, referred to as reject, can be returned to the digester 2, 3 and/or conveyed to a plant for producing knot pulp. After washing the cellulose pulp at positions 5 and 6, the cellulose pulp is conveyed in suspension form to the storage tower 7. The cellulose pulp can be kept in this storage tower for a period of, for example, 4–8 hours (=percolation period). There is usually at least one such storage tower in most sulphate mills, and the reason for it is essentially to create a buffer of cellulose pulp. This arrangement means that one is well prepared for problems arising in the preceding and following treatment stages, including the bleaching stages. The average time spent in the storage tower 7 can naturally vary from mill to mill.

After passing through the storage tower 7, the pulp suspension is conveyed to a washing press 8. Here the pulp consistency is increased so that the cellulose pulp exhibits a high pulp consistency when it is introduced into the oxygen gas delignification (bleaching) reactor 9, where the cellulose pulp is treated with oxygen gas at increased pressure and under alkaline conditions, as previously described. Since the rule of thumb here is that a maximum of 50% of the lignin remaining in the cellulose pulp is removed at the oxygen gas bleaching stage, the lignin content of the cellulose pulp after this stage is ususally 13–18, measured as a kappa number, for conventionally cooked cellulose pulp. The relatively strongly alkaline cellulose pulp is then conveyed to a first washing filter 10 and a second washing filter 11, followed by a washing press 12. After dilution of the cellulose pulp with the suspension liquid, the pulp suspension is introduced into a further storage tower 13. The conditions inside, and the reason for such a storage tower have been described earlier.

The pulp suspension is then conveyed to a washing filter 14. From there, the cellulose pulp is conveyed to a treatment tower 15. Both chlorine dioxide and complexing agents are introduced into the tower, with the result that the cellulose pulp is exposed at this position to a common complexing agent and chlorine dioxide treatment in the manner previously described and exemplified in the following illustrative embodiments. It is especially important to select a complexing agent (or a combination of several complexing agents) which will produce a very strong manganese complex under alkaline conditions in accordance with what has already been stated. The cellulose pulp is then conveyed to two washing filters 16 and 17 in series. It is important for the cellulose pulp to be washed extremely thoroughly in this position, since the aim at this position is to remove the largest possible quantity of transition metals, and in particular manganese, from the cellulose pulp suspension. The aim of adding a complexing agent, for example in the form of EDTA, is mainly to transfer any manganese bonded in the cellulose pulp to a manganese complex that is soluble in the liquid suspension, for example $Mn(EDTA)^{2-}$, but also to deal with other manganese ions and/or to reduce any manganese (hydroxo) oxides that are present in the system. Very thorough washing of the cellulose pulp minimizes the quantity of the $Mn(EDTA)^{2-}$ complex, which accompanies the pulp suspension into the following bleaching tower 18. Because the cellulose pulp in the tower 15 was also treated with chlorine dioxide, both delignification of the cellulose pulp and brightening of same occur in this tower. This means that the lignin content of the cellulose pulp, measured as a kappa number, may have been reduced to 10–15.

In the bleaching tower 18, the cellulose pulp is bleached with a non chlorine-containing, oxidative bleaching agent, preferably hydrogen peroxide. Depending on the conditions encountered at this stage, for example the quantity of hydrogen peroxide added in the charge and the temperature, it is possible to select any stage from far reaching to modest delignification, which means that the lignin content of the cellulose pulp after this stage, measured as a kappa number, can lie within the range 3–10. The cellulose pulp is then conveyed to the washing filter 19.

The cellulose pulp is conveyed from the aforementioned filter to the bleaching tower 20, where it is treated with an appropriate bleaching agent, for example chlorine dioxide, according to the method previously stated. The cellulose pulp is further delignified and brightened at this stage. By how much in each case depends largely on the extent of the brightening and delignification achieved with chlorine dioxide at position 15. Also of significance here is the extent of the delignification and brightening achieved in the preceding hydrogen peroxide stage 18. The cellulose pulp is now conveyed from this bleaching stage to the washing filter 21.

The cellulose pulp is then conveyed to the final bleaching tower 22, where it is bleached with hydrogen peroxide, for example, in earlier stated way. The kappa number ($\chi$) of the fully bleached cellulose pulp lies below the value 2, and the brightness exceeds 85% ISO. The final process is for the cellulose pulp to be conveyed to the washing filter 23. A cellulose pulp of this kind, for example, can either be dried to produce market pulp, or can be transported onwards at a low pulp consistency to a nearby, paper mill, or the cellulose pulp can be handled in both ways. The cellulose pulp can be additionally purified beforehand, if desired, by means of end screening, which is sometimes referred to as fine screening or final screening. Any necessary chemical, for example a substance for adjusting the pH, may be added at the end of the treatment chain.

Until now, attention has been directed essentially at the path of the lignocellulose material, including the cellulose pulp, through the pulp manufacturing process. There now follows a description of the path of the washing (suspension) liquid in the pulp manufacturing process, which is in direct counter-flow to the path of the cellulose pulp. In conjunction with this, a number of critical parameters will be commented upon in greater detail. It may be mentioned, by way of explanation, that the path of the lignocellulose material and the cellulose pulp is shown as a heavy line in the FIGURE, whereas the path of the suspension liquid is shown as a lighter line.

Clean washing (suspension) liquid, preferably in the form of clean water, is applied to the cellulose pulp on the washing filter 23. The quantity of washing liquid added is equivalent, for example, to a dilution factor of 0 to 2. The washing liquid is collected in the storage tank 24 after washing the cellulose pulp. A proportion of the washing liquid is then conveyed in counter-current to the washing filter 21. All the storage tanks for washing liquid have a relatively large volume, since the majority of the washing liquid at each washing stage is used internally in the washing stage for cleaning the filter cloth and diluting the cellulose pulp before it is taken up on the washing filter (i.e. the wire cloth) concerned. A proportion of the washing liquid is also used for diluting the cellulose pulp when it leaves the wire cloth as a continuous web. The quantity of washing liquid required at this position is determined to some extent by the pulp consistency that it is wished to be used in the following treatment stage for the cellulose pulp. The washing liquid in the storage tank 24 can be strongly alkaline, depending on what pH was used in the peroxide bleaching stage 22. If the pH value of the washing liquid is greater than 10, some form of acid must be added, for example to the storage tank 24 or to the washing liquid just after it leaves the storage tank, so as to bring down the pH value to 10 or below, and preferably to below 9.5. Examples of suitable acidification agents are carbonic acid (carbon dioxide) and sulphuric acid. Carbonic acid (carbon dioxide) is preferred, since the use of this chemical also increases the carbonate content of the washing liquid. This additive helps to ensure that the carbonate content of the suspension liquid exceeds the previously indicated critical lowest values at various positions in the treatment chain for the cellulose pulp.

The washing liquid from the washing filter 21 is collected in the storage tank 25, and a proportion of that washing liquid is sprayed onto the pulp web in the washing filter 19, to be collected once more in the storage tank 26.

A proportion of this collected washing liquid is applied to the pulp web in the washing filter 17. Because the washing liquid in the storage tank 26 was recovered in the course of washing cellulose pulp bleached with hydrogen peroxide, its pH value may be strongly alkaline, i.e. it may clearly exceed the pH value 10. If this is the case, the same procedure adopted at positions 24 to 21 must also be adopted here. The washing liquid from the filter 17 is collected in the storage tank 27. A proportion of this washing liquid is conveyed to the washing filter 16, after which the washing liquid is collected in the storage tank 28. From there, a proportion of the washing liquid is conveyed to the washing filter 14, and is then collected in the storage tank 29. A proportion of this washing liquid is conveyed in counter-current and is divided into two flows. One of these is taken to the washing press 12, and the other is used for diluting the highly concentrated cellulose pulp as it leaves the washing press, in order to impart the form of a liquid suspension to the cellulose pulp before it is introduced into the storage tank 13. The liquid removed from the cellulose pulp by pressing in the washing press is collected in the storage tank 30. A proportion of this washing liquid is conveyed in counter-current in series to the washing filter 11, the storage tank 31, the washing filter 10 and the storage tank 32. A proportion of the washing liquid collected in the storage tank 32 is supplied to the washing press 8 in order to be pressed from the cellulose pulp and collected in the storage tank 33. A proportion of this washing liquid is conveyed backwards in the system and is subdivided in turn into two flows. One flow is conveyed to the washing filter 6, and the other flow is used for diluting the cellulose pulp before it is introduced into the storage tower 7.

The washing liquid from the filter 6 is collected in the storage tank 34, and a proportion of this washing liquid is conveyed to the washing filter 5 to be collected in the storage tank 35.

As far as concerns the washing liquid which meets the cellulose pulp before or after the oxygen gas bleaching stage 9, i.e. at positions 8 respectively 10, it is assumed the carbonate contents referred to earlier.

A proportion of the washing liquid in the storage tank 35 is conveyed backwards and is divided up in such a way that a proportion is used for diluting the cellulose pulp to a low consistency ahead of the screening unit 4, and a proportion is introduced into the bottom of the digester 3 for the counter-current displacement (washing) of the digester liquor from the cellulose pulp. The resulting liquor, known as weak liquor, leaves the digester higher up and is conveyed to an evaporation unit, after which the liquor in the form of thick waste liquor is combusted in the recovery boiler. From having been clean water in position 23, for example, the content of both organic and inorganic compounds or substances in the washing liquid has increased in the direction of the counter-current and the weak liquor finally obtained consists of a mixture of digestion liquor and various substances dissolved out and washed out from the various treatment stages in the bleach plant, which is closed from the point of view of its liquid circuit.

The above description is of one embodiment in accordance with the invention. It is, of course, possible within the scope of the invention to deviate from what has been described hitherto, with reference to the FIGURE.

With regard to the initial stage, i.e. the digestion of the lignocellulose material (for example in the form of wood chips), the continuous digester can be replaced by a battery of batch digesters. With reference to batch digesters, there are advantages to be gained from the use of so called displacement digestion. It is also possible to use more than one continuous digester, for instance two. As far as concerns the washing of the pulp at various positions, this is in no way restricted to the use of the washing apparatuses illustrated in the FIGURE. Other washing apparatuses to which consideration may be given include, for example, belt washers, and single-stage and two-stage diffusers, pressurized or otherwize.

The FIGURE illustrates an oxygen gas bleaching stage 9 at a high pulp consistency. It is also entirely possible, of course, to make use of both medium consistency and low consistency bleaching.

The FIGURE shows that the cellulose pulp in position 15, i.e. in one and the same stage, has added to it both a complexing agent and chlorine dioxide, i.e. what is involved here is a common complexing agent and chlorine dioxide bleaching treatment. In accordance with what has already been indicated, the complexing agent may instead be added to the cellulose pulp in a separate treatment stage, i.e. in a separate tower just ahead of position 15 and, more specifically, between position 14 and position 15. It is preferable in such a case for a washing apparatus to be positioned in the path of the cellulose pulp between the aforementioned tower and the chlorine dioxide bleaching tower 15. It is also possible for the complexing agent to be added to the advancing pulp suspension between positions 14 and 15. This embodiment of the invention in many respects resembles the previously described common complexing agent and chlorine dioxide bleaching treatment, which takes place in the tower 15. Finally, the complexing agent can be added directly to the advancing flow of cellulose pulp at any point between the tower 15 and the washing filter 16. It is accordingly possible with such a short contact period between the complexing agent and the cellulose pulp. This method of complexing agent treatment is particularly suitable if the chlorine dioxide bleaching in the tower 15 takes place at a conventional pH value, i.e. at a pH below 3. If such a low pH value is used in the first chlorine dioxide bleaching stage, it will be necessary as a general rule to add to the cellulose pulp an aqueous solution of magnesium sulphate, for example (it is the magnesium ion, i.e. $Mg^{2+}$, that is important in this respect). This aqueous solution must be added to the cellulose pulp at a position/positions after the washing filter 16 and/or after the washing filter 17. If a pH value much higher than that previously indicated is used at position 15, the possibility of adding magnesium must not be excluded, although it may be advisable, and perhaps even necessary, in a number of cases. In these cases, magnesium may be added to the cellulose pulp at any position ahead of the bleaching stage 18. It is also possible to add magnesium to the cellulose pulp before position 22, i.e. before the second hydrogen peroxide bleaching stage.

With reference to the FIGURE the manufacture of bleached softwood sulfate pulp has been described. The source of raw material can just as well be hardwood, of course, for instance birch chips. If hardwood is used, the lignin content of the cellulose pulp in unbleached form is already lower than that which applies to softwood, and the lower content is retained throughout the treatment chain all the way to the fully bleached cellulose pulp.

It is possible within the scope of the invention, from the point of view of a closed liquid circuit, to omit one or more bleaching stages, i.e. the spent liquors from this one or more bleaching stages can be extracted separately from what is otherwise a strictly counter-current washing process and conveyed directly to the recipient, or subjected to some form of external purification before that position. The spent bleaching liquor concerned is that which contains 21 relatively large amount of chloride, i.e. spent liquor from it chlorine dioxide bleaching stage. If a large amount of chlorine dioxide is added at position 20, for example, it may be advisable, and possibly necessary, to permit the spent liquor from the collection tank 25 to leave the system. The same applies to the spent liquor in the collection tank 28 if the charge of chlorine dixoide at bleaching stage 15 is abnormally large. Under normal circumstances, the spent liquor in the collection tank 28 is included in the toally closed liquid system in accordance with the flow diagram illustrated in the FIGURE.

It is also usual for the spent liquor in the collection tank 25 to be discharged as effluent (into a recipient) or to some external purification facility beforehand. If the lignin content of the intitial pulp, i.e. the unbleached pulp, is sufficiently low, then the total requirement for chlorine dioxide will be so low that the liquid system can be totally closed in accordance with what is shown in the flow chart in the FIGURE.

EXAMPLE 1

Details are given below of tests conducted in a birch sulphate pulp mill with a flow chart which, in many respects, resembles that shown in FIG. 1, and in detailed respects up and including the third treatment/bleaching stage agrees with the flow chart in FIG. 1 of Swedish patent publication 9304173-9, the sole difference being the omission of the press 4 with its connecting lines.

Birch chips were digested in a conventional manner in batch digesters, so that the kappa number of the resulting pulp was within the range 15–18. The pulp was then screened, followed by washing of the pulp on a belt washer. After this, the pulp was bleached according to the following bleaching sequence:

Oxygen gas delignification/bleaching (O)-Complexing agent treatment (O)-Hydrogen peroxide bleaching ($P_1$)-Chlorine dioxide bleaching (D)-Hydrogen peroxide bleaching ($P_2$).

The pulp consistency was 11–14% throughout the stages stated above.

The conditions for the oxygen gas bleaching stage were as follows: time=1 hour; temperature=98° C.; oxygen gas charge 14 kg $ptp_{90}$; sodium hydroxide charge=20 kg $ptp_{90}$; magnesium sulphate addition=0.5 kg $Mg^{2+}$ $ptp_{90}$; and pressure at reactor top=3 bar.

2.5 kg of EDTA and 1 kg of $MgSO_4$ per metric ton of 90% pulp=$ptp_{90}$ were added at the complexing agent stage. All the charges at this mill are calculated in this way. Otherwise, the conditions were as follows: time=3 hours. See Table 1 below for details of the temperature, pH and the charged quantity of sulphuric acid ($H_2SO_4$).

The hydrogen peroxide bleaching=$P_1$ was performed at atmospheric pressure, and the charged chemicals were 9 kg of hydrogen peroxide ($H_2O_2$) $ptp_{90}$ and 3 kg of sodium hydroxide (NaOH) $ptp_{90}$. The temperature was 87° C., and the time was 150 minutes.

At the chlorine dioxide bleaching stage (i.e. in position 4), the conditions were as follows: time=3 hours; temperature=55° C. (Q) and 52° C. (DQ); chlorine dioxide charge=26 kg $ptp_{90}$ (Q) and 24 kg $ptp_{90}$ (DQ).

The final hydrogen peroxide bleaching=$P_2$ was performed at atmospheric pressure, and the charged chemicals were 3.5 kg of $H_2O_2$ $ptp_{90}$ and 6 kg of NaOH ptpgo. The temperature was 68° C., and the time was 180 minutes.

The above description is an example of the manufacture of fully bleached birch sulphate pulp in accordance with the prior art.

As an experiment, the following change was made to the method of manufacture for fully bleached birch sulphate pulp described above. The addition of 5 kg of chlorine dioxide ptpgo was commenced at a certain time in the complexing agent stage, so that this stage was changed from a Q stage to a common complexing agent treatment stage and chlorine dioxide bleaching stage=DQ. Table 1 below gives the bleaching results achieved, on the one hand at a certain time in accordance with the conventional bleaching method (O-trial), and on the other hand at a certain time once the new bleaching process had been stabilized (according to the invention). The prevailing temperature, pH and sulphuric acid charge at the DQ stage can be appreciated from Table 1. Otherwise, the conditions at this stage were the same as for the Q stage.

The pulp was washed throughout after each bleaching (treatment) stage, and especially thoroughly after the Q stage and the DQ stage respectively.

TABLE 1

| | O | | Q and DQ | | | | | $P_1$ | | | | | D | $P_2$ | |
|---|---|---|---|---|---|---|---|---|---|---|---|---|---|---|---|
| | κ in | κ in | Visc. $dm^3/kg$ | D charge | Acid l/min | pH | Temp ° C. | κ in | Res. P. g/l | Brightn. % ISO | κ | Δκ | Brightn. % ISO | Brightn. % ISO | Visc. $dm^3/kg$ |
| O-trial | 16.5 | 10.5 | 920 | 0 | 2.0 | 4.3 | 70 | 8.5 | 0.50 | 78.7 | 6.3 | 2.2 | 85.0 | 90.7 | 802 |
| Invent. | 15.5 | 10.5 | 872 | 5 | 0.2 | 4.5 | 66 | 8.1 | 0.63 | 85.9 | 5.5 | 2.6 | 89.8 | 92.1 | 850 |

The brightness was measured according to measurement method SCAN-C11:75. The kappa (χ) numbers were measured according to measurement method SCAN-C1:77, and the intrinsic viscosity was measured according to measurement method SCAN-C15:62. This is the case not only for these measurement values, but also throughout this specification.

As will be appreciated, the addition of 5 kg of chlorine dioxide ptp,, in the second treatment stage causes the brightness of the pulp to increase by 7.2% ISO after the first hydrogen peroxide stage. The chlorine dioxide also has a certain delignifying effect, as can be appreciated from the reduction in the kappa number after the first hydrogen peroxide stage compared with the reduction in the kappa number after the first hydrogen peroxide stage when a conventional Q stage was used (O-trial).

The fact that the residual peroxide content after the first hydrogen peroxide stage is unchanged (allowing for the natural variations that occur), or possibly slightly higher in the method in accordance with the invention compared with the O-trial, shows that the chlorine dioxide has not reacted to any significant degree with, or in some other way produced a negative effect on the complexing agent (=EDTA). If this had occurred, then the removal of manganese from the pulp would have been impaired, and in this case more manganese would have remained present in the pulp during the first hydrogen peroxide stage, which in turn would have led to increased peroxide decompostion resulting in lower brightness and/or a reduced quantity of residual hydrogen peroxide after the bleaching stage.

The added complexing agent takes care of most of the manganese that is bonded in the pulp and forms the water-soluble complex $Mn(EDTA)^{2-}$. Since the pH value of the common complexing agent treatment and chlorine dioxide bleaching stage is relatively high, most of the natural magnesium is retained in the pulp after said stage, and since magnesium in the form of magnesium sulphate is added to the cellulose pulp, the magnesium/manganese mol quotient of the pulp, at the time when it is added to the first hydrogen peroxide bleaching stage, is considerably above the quotient previously stated as critical.

It is important to note that the viscosity of the fully bleached pulp manufactured in accordance with the invention is as good as 850 $dm^3/kg$, in spite of the fact that the viscosity of the pulp entering the DQ stage was as low as; 872. This must be compared with the O-trial, in which the viscosity of the fully bleached pulp was only 802 $dm^3/kg$, in spite of the fact that the viscosity of the pulp entering the Q stage in that case was as high as 920 $dm^3/kg$.

It can also be appreciated that the need for the addition of acid ($H_2SO_4$) respectively at the Q stage and the DQ stage, i.e. respectively in accordance with the O-trial and in accordance with the invention, reduces from 2 liters per minute to 0.2 liters per minute. This is advantageous, since it has the effect of reducing the addition of sulphur to the process.

During the period for which chlorine dioxide and complexing agents were added to the cellulose pulp at the same stage, the washing liquid was conveyed from the washing operation after the first hydrogen peroxide stage in strict counter-current backwards through the entire process in accordance with the preferred embodiment of the method in accordance with the invention, so that the majority of the spent liquor from the bleaching plant was absorbed in the spent liquor from the digester and was combusted in the recovery boiler after evaporation. The closing of the liquid system in the previously described fashion took place over a period of 17 days. No problems were encountered in the chemical recovery cycle, just as none were encountered in conjunction with the return (precipitation) of manganese to the cellulose pulp, because the water soluble manganese complexes have been dissolved at one or other of the positions in the pulp manufacturing chain. This in turn can be attributed to the fact that both the pH value in the suspension (washing) liquid and its carbonate content at various positions were controlled in accordance with what has previously been stated in this specification.

EXAMPLE 2

A sulphate pulp made from softwood (primarily pine) with the kappa number in the range from 25–28, which had been oxygen gas bleached in accordance with the conventional method, was sampled in a mill and washed thoroughly in the laboratory using distilled water, before being subjected there to the treatment described below. This pulp has the kappa number 16.5, brightness 35.6% ISO, and viscosity 944 $dm^3$/kg. The pulp was also analyzed in respect of its metal content, and the manganese content was found to be 45 mg/kg, whereas the magnesium content was 360 mg/kg. The metal content was determined by means of atomic absorption, and the quantities are indicated here, as elsewhere, in mg/kg of absolutely dry pulp.

The oxygen gas bleached pulp was treated in the four sequences indicated below:

DP
DMgP
(DQ)P and
(DQ)MgP.

D stands for chlorine dioxide. P stands for hydrogen peroxide. Mg stands for the addition of magnesium sulphate, and (DQ) stands for a common complexing agent and chlorine dioxide bleaching stage in accordance with the invention. The experiments numbered 1 to 8 were performed at two different pH levels at the chlorine dioxide bleaching stage.

20 kg of chlorine dioxide ptp, calculated as active chlorine, were added at the chlorine dioxide bleaching stage.

The bleaching was performed in plastic bags at 70° C. for 180 minutes at a pulp consistency of 10%. In order to achieve the desired break-pH, the quantities of sulphuric acid ($H_2SO_4$) or alkali in the form of sodium hydroxide (NaOH) stated in Table 2 below were added. The chlorine dioxide was consumed entirely in all the experiments. On completion of the chlorine dioxide stage, the pulp was washed thoroughly with distilled water. The parameters for the (DQ) stage agree with those for the D stage, apart from the addition of 2 kg of EDTA ptp to the pulp.

The hydrogen peroxide bleaching was performed in plastic bags with a charge of 10 kg of hydrogen peroxide ptp and 10 kg of sodium hydroxide ptp, giving an initial pH of approximately 11.5. The pulp consistency was 10%, the temperature 90° C. and the time 180 minutes. On completion of the bleaching, samples were taken for the purpose of determining the residual peroxide, after which the pulp was washed thoroughly with distilled water.

The pulp was impregnated with magnesium, if required, by fibration of the washed pulp to a pulp consistency of approximately 3% in an aqueous solution containing 0.5 kg of $Mg^{2+}$ ptp added in the form of magnesium sulphate. Adjustment of the pH to almost neutral, i.e. pH 7, was done by adding the quantities of sodium hydroxide indicated in Table 2 below. The pulp suspension was then allowed to stand at room temperature for 10 minutes, after which the pH was measured and the pulp was once more washed thoroughly with distilled water. The experiments without magnesium impregnation of the pulp involved similar treatment of the pulp, but without the addition of magnesium.

The residual peroxide content was determined by iodometric titration in accordance with a standard method described in "Textbook of Quantitative Inorganic Analysis", The MacMillan Company, Third Edition 1952, Kolthoff and Sandell, page 600. The pulp was analyzed for determination of the kappa number, brightness and viscosity in accordance with previously indicated standard methods. After the D and DQ stages respectively, the content of manganese and magnesium in the pulp were determined in accordance with the previously described method.

The results obtained can be found in Table 2 below.

TABLE 2

| | | D | | | | After D and DQ | | | | Mg | | P | | | |
|---|---|---|---|---|---|---|---|---|---|---|---|---|---|---|---|
| Expt. No | Sequence | Acid kg ptp | Alkali kg ptp | pH | EDTA kg ptp | Mg mg/kg | Mn mg/kg | Mg/Mn mol/mol | $Mg^{2+}$ kg ptp | Alkali kg ptp | pH | Resid. P. kg ptp | κ | Brightn. % ISO | Visc. $dm^3$/kg |
| 1 | DP | 3 | 0 | 2.7 | 0 | 37 | 4.9 | 17 | 0 | 1.4 | 6.9 | 0 | 3.6 | 65.8 | 812 |
| 2 | DMgP | 3 | 0 | 2.7 | 0 | " | " | " | 0.5 | 1.3 | 5.6 | 1.9 | 3.3 | 72.8 | 827 |
| 3 | (DQ)P | 3 | 0 | 2.8 | 2 | 44 | 3.8 | 26 | 0 | 1.3 | 6.8 | 0 | 3.7 | 66.4 | 827 |
| 4 | (DQ)MgP | 3 | 0 | 2.8 | 2 | " | " | " | 0.5 | 1.3 | 5.6 | 2.2 | 3.5 | 72.3 | 872 |
| 5 | DP | 0 | 2.2 | 4.8 | 0 | 122 | 18.4 | 15 | 0 | 0.5 | 7.3 | 0.1 | 4.7 | 65.0 | 835 |
| 6 | DMgP | 0 | 2.2 | 4.8 | 0 | " | " | " | 0.5 | 0.5 | 6.5 | 1.0 | 4.2 | 72.1 | 844 |
| 7 | (DQ)P | 0 | 1.8 | 4.8 | 2 | 124 | 1.9 | 147 | 0 | 0.5 | 7.5 | 3.2 | 4.7 | 72.2 | 903 |
| 8 | (DQ)MgP | 0 | 1.8 | 4.8 | 2 | " | " | " | 0.5 | 0.5 | 6.9 | 3.8 | 4.8 | 71.5 | 906 |

The experiments in accordance with the shortest treatment sequence, i.e. 1 and 5, were performed according to the prior art. The only difference between these two experiments is that a conventional low pH value, i.e. a pH of 2.7, was used in the chlorine dioxide stage in experiment 1, and the pH was significantly higher in experiment 5, namely 4.8. The brightness of the pulp after the hydrogen peroxide stage was approximately equally low in both experiments. The kappa number in experiment 1 was 3.6, and the viscosity was 812 $dm^3$/kg, at which all the hydrogen peroxide was consumed. The kappa number in experiment 5 was 4.7, and the viscosity was 835, at which an extremely small quantity of hydrogen peroxide remained after the bleaching stage. These two experiments were essentially equivalent from the point of view of selectivity.

Experiments 2 and 6 are similar to the experiments commented on above, but with the important difference that, in both these experiments, magnesium was added to the pulp after the respective chlorine dioxide bleaching stages. In both those experiments, the pulp bleached with hydrogen peroxide exhibits excellent brightness and acceptable viscosity, and significant residual peroxide contents were recorded in both cases. As in the previously described experiments, a higher pH-value in the chlorine dioxide bleaching leads to a higher viscosity of the pulp by comparison with a conventional pH value at the D stage, although on the other hand this pulp exhibits a somewhat higher lignin content, measured as kappa number. If the experiments 2 and 6 are compared with the experiments 1 and 5, it will be appreciated that the first named pulps, after the chlorine dioxide stage and the addition of magnesium, have a significantly higher Mg/Mn quotient (not apparent from the Table), which explains the far higher brightness and residual peroxide content. The experiments 2 and 6 are not covered by the present invention, although in spite of this it is clear from these experiments that it is entirely possible to achieve an acceptable bleaching result (certain persons may even regard this as a very good bleaching result) in a cellulose pulp with the described treatment sequence.

The experiments 3, 4, 7 and 8, which contain a common chlorine dioxide bleaching stage and complexing agent treatment stage, were performed in accordance with the method in accordance with the invention. An optimal result was obtained in the experiments 4, 7 and 8, and the experiment 7 exhibits a brightness of 72.2 and a viscosity of 903 kg/$dm^3$ at a kappa number of 4.7 and a residual peroxide content of 3.2 kg ptp. This excellent result is explained, at least in part, by the fact that the pH value at the common DQ stage is relatively high, namely 4.8, which is entirely in accordance with an absolutely preferred embodiment of the present invention. This high pH value at that position means that extremely little of the magnesium present in the pulp is leached out in this position, whereas the complexing agent removes from the pulp a large proportion of the manganese that is present in the pulp, which together lead to the desired high magnesium/manganese mol quotient. In the experiment 8, the pulp after the hydrogen peroxide stage exhibits largely identical pulp characteristics for approximately the same residual peroxide content. A method in accordance with experiment 7 is preferable, however, when compared with a method in accordance with experiment 8, since the cost of the added magnesium is saved. It is clear, on the other hand, that the added magnesium does not produce any negative effect.

The experiments 3 and 4 illustrate the need, if a low pH, i.e. 2.8, is used in the common DQ stage, to add magnesium to the pulp after the aforementioned stage, so that the magensium/manganese mol quotient is the desired quotient, i.e. it exceeds a certain threshold value, when the pulp is conveyed to the hydrogen peroxide stage, if it is wished to achieve an optimal bleaching result. The use of such a low pH-value at the aforementioned stage is known to result in the leaching out of far too much of the natural magnesium from the pulp, and that this leached quantity must be replaced afterwards, at least in a certain proportion.

The pulp in accordance with experiment 4 has the same brightness as, but a lower viscosity, than the pulps in accordance with the experiments 7 and 8. It should be noted, however, that the first mentioned pulp is delignified to a greater extent, i.e. with a kappa number 3.5 that must be compared with the kappa numbers 4.7 and 4.8. As far as the residual peroxide content is concerned, there is a significant difference, to the disadvantage of the pulp in accordance with experiment 4.

EXAMPLE 3

The same pulp as in Example 2 is used in this series of laboratory experiments. As previously stated, the; pulp had the kappa number 16.5, the brightness 35.6% ISO, and the viscosity 944 $dm^3$/kg. The manganese content of the pulp was 45 mg/kg, and its magnesium content was 360 mg/kg.

This sulphate pulp, which had been manufactured in the mill from softwood (mainly pine) and bleached with oxygen gas, was treated in the following two sequences:

$D_1MgP_1D_2MgP$, and $(DQ)MgP_1D_2MgP_2$.

D stands for chlorine dioxide, P stands for hydrogen peroxide, Mg stands for magnesium addition and (DQ) stands for a common complexing agent treatment and chlorine dioxide bleaching stage in accordance with the invention.

The experiments with the numbers 9 to 18 were performed in accordance with the first sequence, and the experiments with the numbers 19 to 28 were performed in accordance with the second sequence, i.e. in accordance with an embodiment of the method in accordance with the invention.

In the first chlorine dioxide bleaching stage, 20 kg of chlorine dioxide ptp were charged, calculated as active chlorine. The bleaching was performed in plastic bags at 70° C. for 180 minutes at a pulp consistency of 10%. In order to obtain the desired break-pH, the quantities of sulphuric acid ($H_2SO_4$) or alkali in the form of sodium hydroxide (NaOH) stated in Table 3 below were added. In some of the experiments, active chlorine was still present after the end of the bleaching stage, and its content was determined by iodometric titration in accordance with the method described in Kirk-Othmer, "Encyclopedia of Chemical Technology", 3rd. Edition, Vol. 5, p. 617 f., John Wiley & Sons.

On completion of the chlorine dioxide stage, the pulp was washed thoroughly with distilled water. The parameters for the (DQ) stage agree with those for the $D_1$ stage, apart from the addition of 2 kg of EDTA ptp to the pulp.

In all the experiments, magnesium sulphate was then added to the cellulose pulp entirely in accordance with what is more described in Example 2. This treatment was repeated once more after the second chlorine dioxide bleaching ($D_2$)stage.

The first hydrogen peroxide bleaching stage was performed in plastic bags with a charge of 2.5 kg of hydrogen peroxide ptp and 6 kg of sodium hydroxide ptp, giving an initial pH of approximately 11.5. The pulp consistency was 10%, the temperature 70° C. and the time 180 minutes. On completion of the bleaching, samples of the suspension liquid were taken for the purpose of determining the residual peroxide, after which the pulp was washed thoroughly with distilled water.

In the second chlorine dioxide bleaching stage, 15 kg of chlorine dioxide ptp were charged, calculated as active chlorine. The bleaching was performed in plastic bags at 70° C. for 180 minutes at a pulp consistency of 10%. Adjustment of the pH through the addition of sulphuric acid or sodium hydroxide was not performed. It also emerged that no residue of active chlorine was present in any case in the suspension liquid after the end of the bleaching stage. On completion of the bleaching stage, the pulp was washed thoroughly with distilled water.

The second hydrogen peroxide bleaching stage was performed in plastic bags with a charge of 10 kg of hydrogen peroxide ptp and 10 kg of sodium hydroxide ptp, giving an initial pH of approximately 11.5. The pulp consistency was 10%, and the temperature was 90° C. for 90 minutes or 105° C. for 120 minutes. On completion of the bleaching, samples of the suspension liquid were taken for the purpose of determining the residual peroxide, after which the pulp was washed thoroughly with distilled water.

The residual peroxide content was determined by iodometric titration in accordance with previously described standard method. The pulp was analyzed in respect of the kappa number, brightness and viscosity in accordance with previously stated standard methods. After the $D_1$ and DQ stages respectively, the content of manganese and magnesium in the pulp were determined in accordance with the previously described method.

The results obtained can be found in Table 3 below.

TABLE 3

| | | $D_1$ and DQ | | | | | | After $D_1$ and DQ | | |
|---|---|---|---|---|---|---|---|---|---|---|
| Expt. No. | Sequence | Acid kg ptp | Alkali kg ptp | Target pH | Meas. pH | R-chlor kg ptp | EDTA kg ptp | Mg mg/kg | Mn mg/kg | Mg/Mn mol/mol |
| 9 | $D_1MgP_1D_2MgP_2$ | 0.8 | 0 | 3 | 3.1 | 0 | 0 | 55 | 7.4 | 17 |
| 10 | " | 0.8 | 0 | 3 | 3.1 | 0 | 0 | 55 | 7.4 | 17 |
| 11 | " | 0 | 1.1 | 4 | 3.9 | 0 | 0 | 94 | 13.6 | 16 |
| 12 | " | 0 | 1.1 | 4 | 3.9 | 0 | 0 | 94 | 13.6 | 16 |
| 13 | " | 0 | 2.2 | 5 | 4.8 | 0 | 0 | 122 | 17.9 | 15 |
| 14 | " | 0 | 2.2 | 5 | 4.8 | 0 | 0 | 122 | 17.9 | 15 |
| 15 | " | 0 | 4 | 6 | 6.3 | 1.3 | 0 | 162 | 25.8 | 14 |
| 16 | " | 0 | 4 | 6 | 6.3 | 1.3 | 0 | 162 | 25.8 | 14 |
| 17 | " | 0 | 7 | 7 | 7.5 | 4.6 | 0 | 222 | 34.4 | 15 |
| 18 | " | 0 | 7 | 7 | 7.5 | 4.6 | 0 | 222 | 34.4 | 15 |
| 19 | $(DQ)MgP_1D_2MgP_2$ | 1.6 | 0 | 3 | 3.3 | 0 | 2 | 57 | 1.9 | 68 |
| 20 | " | 1.6 | 0 | 3 | 3.3 | 0 | 2 | 57 | 1.9 | 68 |
| 21 | " | 0 | 0.5 | 4 | 4.1 | 0 | 2 | 95 | 1.1 | 195 |
| 22 | " | 0 | 0.5 | 4 | 4.1 | 0 | 2 | 95 | 1.1 | 195 |
| 23 | " | 0 | 1.8 | 5 | 5.0 | 0 | 2 | 124 | 1.1 | 255 |
| 24 | " | 0 | 1.8 | 5 | 5.0 | 0 | 2 | 124 | 1.1 | 255 |
| 25 | " | 0 | 3 | 6 | 6.1 | 0.2 | 2 | 141 | 2 | 159 |
| 26 | " | 0 | 3 | 6 | 6.1 | 0.2 | 2 | 141 | 2 | 159 |
| 27 | " | 0 | 6.4 | 7 | 7.2 | 3.5 | 2 | 195 | 7.2 | 61 |
| 28 | " | 0 | 6.4 | 7 | 7.2 | 3.5 | 2 | 195 | 7.2 | 61 |

| | $P_1$ | | | | $D_2$ | | | | $P_2$ | | | |
|---|---|---|---|---|---|---|---|---|---|---|---|---|
| Expt. No. | Resid. P. kg ptp | κ | Brightn. % ISO | Visc. $dm^3/kg$ | κ | Brightn. % ISO | Visc. $dm^3/kg$ | Temp. ° C. | Resid. P. kg ptp | κ | Brightn. % ISO | Visc. $dm^3/kg$ |
| 9 | 0.3 | 6.5 | 55.2 | 882 | 2.4 | 68.5 | 871 | 90 | 3.8 | 1.1 | 85.1 | 770 |
| 10 | 0.3 | 6.5 | 55.2 | 882 | 2.4 | 68.5 | 871 | 105 | 0.7 | 0.9 | 86.9 | 701 |
| 11 | 0.1 | 7.2 | 55.7 | 909 | 2.6 | 67.0 | 884 | 90 | 4.8 | 1.2 | 84.9 | 820 |
| 12 | 0.1 | 7.2 | 55.7 | 909 | 2.6 | 67.0 | 884 | 105 | 1.3 | 1.1 | 86.6 | 759 |
| 13 | 0.1 | 7.4 | 56.6 | 914 | 2.7 | 66.2 | 882 | 90 | 4.4 | 1.3 | 84.6 | 815 |
| 14 | 0.1 | 7.4 | 56.6 | 914 | 2.7 | 66.2 | 882 | 105 | 1.3 | 1.0 | 86.5 | 774 |
| 15 | 0 | 8.1 | 55.7 | 930 | 3.3 | 63.4 | 892 | 90 | 3.7 | 1.6 | 83.7 | 824 |
| 16 | 0 | 8.1 | 55.7 | 930 | 3.3 | 63.4 | 892 | 105 | 0.8 | 1.4 | 85.4 | 767 |
| 17 | 0 | 9.5 | 50.5 | 927 | 4.2 | 58.0 | 899 | 90 | 2.4 | 2.0 | 81.3 | 818 |
| 18 | 0 | 9.5 | 50.5 | 927 | 4.2 | 58.0 | 899 | 105 | 0.1 | 1.9 | 82.8 | 783 |
| 19 | 0.4 | 6.9 | 55.7 | 926 | 2.5 | 67.0 | 901 | 90 | 6.3 | 1.2 | 84.7 | 853 |
| 20 | 0.4 | 6.9 | 55.7 | 926 | 2.5 | 67.0 | 901 | 105 | 3.6 | 1.2 | 87.0 | 812 |
| 21 | 0.5 | 7.3 | 56.0 | 943 | 2.8 | 66.3 | 898 | 90 | 6.4 | 1.3 | 84.4 | 859 |
| 22 | 0.5 | 7.3 | 56.0 | 943 | 2.8 | 66.3 | 898 | 105 | 3.9 | 1.0 | 86.9 | 821 |
| 23 | 1.0 | 7.6 | 56.8 | 949 | 2.8 | 65.5 | 905 | 90 | 6.7 | 1.3 | 84.4 | 855 |
| 24 | 1.0 | 7.6 | 56.8 | 949 | 2.8 | 65.5 | 905 | 105 | 3.4 | 1.1 | 86.1 | 854 |
| 25 | 0.7 | 8 | 57 | 941 | 3.2 | 64.1 | 906 | 90 | 6.3 | 1.5 | 84.1 | 871 |
| 26 | 0.7 | 8 | 57 | 941 | 3.2 | 64.1 | 906 | 105 | 3.4 | 1.3 | 86.2 | 827 |
| 27 | 0.4 | 9.2 | 54.8 | 941 | 3.8 | 60.2 | 897 | 90 | 5.3 | 1.7 | 82.9 | 843 |
| 28 | 0.4 | 9.2 | 54.8 | 941 | 3.8 | 60.2 | 897 | 105 | 2.3 | 1.5 | 85.2 | 817 |

It can be appreciated from the above Table that an increase in the pH from 3 to 7 in the first chlorine dioxide bleaching stage is accompanied by a similar change in the magnesium content of the pulp, both with and without the addition of a completing agent, i.e. EDTA. On the other hand, the manganese content of the pulp is consistently much lower in the experiments with the addition of EDTA to the pulp. It can also be appreciated that the mol quotient Mg/Mn is 17 or lower in experiments 9 to 18, whereas in experiments 19 to 28 it is at least 61. In the experiments 22 and 23, i.e. at pH 5 and with the addition of EDTA, the quotient is at its highest level, namely 255. These experiments also give the highest residual peroxide content and the highest viscosity after the first hydrogen peroxide bleaching stage. The residual peroxide content in the suspension liquid and the viscosity of the pulp are consistently higher after the first hydrogen peroxide bleaching stage in the experiments according to the invention, i.e. 19 to 28, compared with the experiments 9 to 18.

The higher viscosity of the pulp in the experiments in accordance with the invention also remains present after the second chlorine dioxide bleaching stage, and the higher viscosity level is particularly pronounced after the second hydrogen peroxide bleaching stage. In the same way as after the first hydrogen peroxide bleaching stage, the residual peroxide level in the suspension liquid after the second hydrogen peroxide bleaching stage is consistently higher for the experiments in which EDTA was added to the pulp in the first chlorine dioxide bleaching stage, in spite of the fact that the magnesium impregnation was applied after both the chlorine dioxide bleaching stages, a method which, in Example 2, proved to give an increased residual peroxide content in the suspension liquid, although not as high as with the addition of EDTA in accordance with the invention.

The experiments at pH 3 reveal the advantages of the method in accordance with the inventions particularly clearly. With a combined chlorine dioxide and complexing agent treatment stage in accordance with the invention, the resulting viscosity achieved in the final bleached pulp is 83 $dm^3$/kg higher at a temperature of 90° C. in the second hydrogen peroxide bleaching stage (compare experiment 19 with experiment 9) and 111 $dm^3$/kg higher at a temperature of 105° C. in the second hydrogen peroxide bleaching stage (compare experiment 20 with experiment 10), than if the first chlorine dioxide bleaching stage is performed in accordance with the prior art.

The differences in hydrogen peroxide consumption are considerable, furthermore, with the lowest consumption (highest residual peroxide content in the suspension liquid) being achieved by the method in accordance with the invention. Even at pH 5, for example, at the first stage, which is a more optimal level for EDTA, corresponding advantages are obtained with regard to the viscosity of the final bleached pulp and the consumption of peroxide in the second hydrogen peroxide bleaching stage. The brightness values for the pulp in the experiments simulating the method in accordance with the invention are at all times comparable with those in the experiments simulating the prior art, i.e, where only chlorine dioxide is charged in the first stage. This means that there is no need to sacrifice the brightness of the pulp in order to gain the quality advantages associated with a higher pulp viscosity level.

The results also show that it is entirely possible (and perhaps advantageous in certain cases) to impregnate the cellulose pulp with magnesium, not only after the first common chlorine dioxide bleaching stage and complexing agent treatment stage, but also after the second chlorine dioxide treatment stage, in those cases in which the pulp is fully bleached, i.e. to achieve a relatively high final brightness, in accordance with the bleaching sequence described above.

It is also possible, of course, to utilize the bleaching sequence described here to achieve both higher and lower final brightness values for the pulp by varying the charges of chlorine dioxide and peroxide, as well as other treatment parameters in the various stages, to an extent familiar to a person skilled in the art.

What is claimed is:

1. Method for the manufacturing of bleached cellulose pulp, in conjunction with which lignocellulose material that contains transition metals is digested to form cellulose pulp by means of an alkaline digestion liquor, and then the cellulose pulp in the form of a suspension is subjected in series to at least a stage of chlorine dioxide bleaching (D) and a stage of bleaching with a non-chlorine containing, oxidative bleaching agent;

with said stages of bleaching interspersed with at least washing with a liquid and/or reconcentration of the cellulose pulp, and wherein a complexing agent that complexes the transition metals is added to the cellulose pulp in conjunction with the chlorine dioxide bleaching (D), wherein the liquid removed from the pulp in conjunction with the washing and/or reconcentration of the cellulose pulp is conveyed in essentially strict countercurrent, in such a way that the pulp manufacturing process is essentially totally closed with regard to the liquid circuit; and the pH value of the suspension liquid, is maintained at $\leqq 10$, in the absence of a reduction agent, from said chlorine dioxide bleaching stage of the cellulose pulp following digestion and onwards throughout each of the cellulose pulp treatment stages prior to the bleaching stage with the non-chlorine containing, oxidative bleaching agent; and wherein a carbonate content of the suspension liquid is maintained at or in excess over a minimum value for each stage of the method, said minimum value determined by the stage in cellulose pulp treatment, said pH value and said carbonate content controlled in a manner to prevent breakdown of complexes of the complexing agent and the transition metals in the suspension liquid in every position backwards through a washing stage that occurs in the direction of pulp flow before the chlorine dioxide bleaching stage.

2. Method in accordance with claim 1, characterized in that the complexing agent is added to the cellulose pulp at a position ahead of the chlorine dioxide bleaching stage.

3. Method in accordance with claim 1, characterized in that the complexing agent is added to the cellulose pulp at a position after the chlorine dioxide bleaching stage.

4. Method in accordance with claim 1, characterized in that the complexing agent is added to the cellulose pulp during the chlorine dioxide bleaching stage.

5. Method in accordance with claim 4, characterized in that the pH value in 3–7 throughout the common complexing agent treatment stage and chlorine dioxide bleaching stage.

6. Method in accordance with claim 5, characterized in that the pH Value is 4–6.

7. Method in accordance with claim 1, characterized in that the mol quotient of the cellulose pulp for magnesium/manganese during the bleaching stage with a non-chlorine containing agent is maintained at or brought to a value exceeding 20.

8. Method in accordance with claim 7, characterized in that the mol quotient of the cellulose pulp for magnesium/manganese during the bleaching with a non-chlorine containing oxidative bleaching agent is maintained at or brought to a value exceeding 40.

9. Method in accordance with claim 1, characterized in that magnesium is added to the cellulose pulp in any stage at the latest just ahead of the bleaching stage with non-chlorine containing oxidative agent, if the cellulose pulp, either from the start or because of its treatment before the bleaching stage with a non-chlorine containing oxidative bleaching agent, exhibits a mol quotient for magnesium/manganese which is below 20.

10. Method in accordance with claim 1, characterized in that the chlorine dioxide bleaching stage of the cellulose pulp is performed at a pH value of 1.5–3.5, and in that magnesium is added to the cellulose pulp at a following stage.

11. Method in accordance with claim 1, characterized in that the complexing agent is added in a quality that is at least equivalent to the stoichiometric quantity of complexing agent vis-a-vis the total quality of manganese in the cellulose pulp and in the surrounding liquid after the chlorine dioxide bleaching stage.

12. Method in accordance with claim 1, characterized in that the complexing agent (L) has a conditional complexing constant for divalent manganese $Mn^{2+}$ for the reaction $Mn^{2+}+L^{n-}\approx MnL^{2-n}$, which exceeds $10^{11}$, at a pH of 12.

13. Method in accordance with claim 12, characterized in that the complexing agent (L) is ethylene diamine tetraacetic (EDTA) and/or diethylene triamine pentaacetic acid (DTPA).

14. Method in accordance with claim 1, characterized in that the cellulose pulp is washed thoroughly before the bleaching stage with the non-chlorine containing, oxidative bleaching agent.

15. Method in accordance with claim 1, characterized in that the non chlorine-containing, oxidative bleaching agent consists of a per-compound (P).

16. Method in accordance with claim 15, characterized in that the per-compound (P) is hydrogen peroxide.

17. Method in accordance with claim 1, characterized in that the carbonate content of the suspension liquid, which meets the cellulose pulp in conjunction with the washing of the pulp immediately before the first bleaching stage, is equal to or greater than 10 millimol/liter.

18. Method in accordance with claim 17, characterized in that the carbonate content of the suspension liquid, which meets the cellulose pulp in conjunction with the washing of the pulp immediately before the first bleaching stage, exceeds 40 millimol/liter.

19. Method in accordance with claim 1, characterized in that the carbonate content of the suspension liquid during the bleaching stage with the non-chlorine containing, oxidative bleaching agent is equal to or greater than 3 millimol per liter.

20. Method in accordance with claim 1, characterized in that fully bleached cellulose pulp is manufactured using chlorine dioxide (D) followed by peroxide (P) as the final bleaching stages.

21. Method in accordance with claim 1, characterized in that both said initial delignification stage and said initial bleaching stage are used in which an oxygen gas delignification (O) stage precedes said chlorine dioxide bleaching (D) stage.

22. Method in accordance with claim 21, characterized in that the carbonate content of the suspension liquid which meets the cellulose pulp in conjunction with washing of same after the oxygen gas delignification is equal to or greater than 4 millimol/liter.

23. Method in accordance with claim 21, characterized in that the carbonate content of the suspension liquid, which meets the cellulose pulp in conjunction with the washing of same after the oxygen gas delignification stage, exceeds 10 millimol/liter.

24. Method in accordance with claim 21, characterized in that the cellulose pulp in the form of a suspension is screened after the digestion stage and before the delignification/bleaching stage.

25. Method in accordance with claim 1, characterized in that the cellulose pulp in the form of a suspension is screened after the digestion stage and before the delignification/bleaching stage.

26. Method in accordance with claim 1, further comprising an initial delignification stage of the cellulose pulp following digestion, said initial delignification stage preceding said stage of chlorine dioxide bleaching, wherein the liquid removed from the pulp in conjunction with the washing and/or reconcentration of the cellulose pulp is conveyed in essentially strict countercurrent, in such a way that the pulp manufacturing process is essentially totally closed with regard to the liquid circuit and the pH value of the suspension liquid, is controlled to be $\leqq 10$, in the absence of a reduction agent, from said initial delignification stage of the cellulose pulp following digestion and onwards throughout cellulose pulp treatment as far as into the bleaching stage with the non chlorine-containing, oxidative bleaching agent; and wherein said pH value and said carbonate content are controlled in a manner to prevent breakdown of complexes of the complexing agent and the transition metals in the suspension liquid in every stage backwards through a washing stage that occurs in the direction of pulp flow before the initial delignification stage.

* * * * *